US008771400B2

(12) United States Patent
Hiraoka

(10) Patent No.: US 8,771,400 B2
(45) Date of Patent: Jul. 8, 2014

(54) METHOD FOR MANUFACTURING MOLTEN IRON

(75) Inventor: Teruyoshi Hiraoka, Kobe (JP)

(73) Assignee: ISTC Co., Ltd., Kobe-shi (JP)

( * ) Notice: Subject to any disclaimer, the term of this patent is extended or adjusted under 35 U.S.C. 154(b) by 412 days.

(21) Appl. No.: 13/320,325

(22) PCT Filed: May 14, 2010

(86) PCT No.: PCT/JP2010/058192

§ 371 (c)(1),
(2), (4) Date: Nov. 14, 2011

(87) PCT Pub. No.: WO2010/131740

PCT Pub. Date: Nov. 18, 2010

(65) Prior Publication Data

US 2012/0060650 A1 Mar. 15, 2012

(30) Foreign Application Priority Data

May 15, 2009 (JP) ..... 2009-118288

(51) Int. Cl.

| | |
|---|---|
| ***C21C 5/28*** | (2006.01) |
| ***C21C 5/32*** | (2006.01) |
| ***C21C 5/34*** | (2006.01) |
| ***C21C 5/35*** | (2006.01) |
| ***C21C 5/48*** | (2006.01) |
| ***C21C 1/00*** | (2006.01) |

(52) U.S. Cl.
USPC ..... 75/569; 75/560

(58) Field of Classification Search
CPC ..... C02C 5/28; C02C 5/32; C02C 5/34; C02C 5/3511; C21C 1/00; C21C 1/02
USPC ..... 75/438, 507, 524, 528–531, 536, 533, 75/540, 544, 548, 551–557, 560, 569
See application file for complete search history.

(56) References Cited

U.S. PATENT DOCUMENTS

| | | | | | |
|---|---|---|---|---|---|
| 3,615,356 | A | * | 10/1971 | Grenfell | 75/529 |
| 3,904,399 | A | * | 9/1975 | Murton | 75/534 |

FOREIGN PATENT DOCUMENTS

| | | | |
|---|---|---|---|
| JP | 58-193309 | A | 11/1983 |
| JP | 62-192520 | A | 8/1987 |
| JP | 06-256832 | A | 9/1994 |
| JP | 09-256022 | A | 9/1997 |
| JP | 2003-194307 | A | 7/2003 |
| JP | 2005-015891 | A | 1/2005 |
| JP | 2005-290515 | A | 10/2005 |
| JP | 2006-342370 | A | 12/2006 |
| WO | WO-2010/032642 | A1 | 3/2010 |

OTHER PUBLICATIONS

International Search Report dated Aug. 24, 2010, issued for PCT/JP2010/058192.

* cited by examiner

*Primary Examiner* — Kaj K Olsen
*Assistant Examiner* — Jared Wood
(74) *Attorney, Agent, or Firm* — Edwards Wildman Palmer LLP

(57) ABSTRACT

An object of the present invention is to provide a method for producing molten iron, the method being capable of minimizing the generation of converter dust and increasing the thermal degree of freedom in the converter process. In addition, the present invention provides a method for improving a converter operation method in the production of steels. The present invention relates to a method for producing molten iron including the steps of: 1) supplying carbon-containing molten pig iron to a converter, 2) continuously supplying iron oxide into the converter, and 3) blowing a mixed gas comprising a fuel gas and a combustion-supporting gas at a speed equal to or faster than the speed of sound to the molten pig iron to cause a combustion reaction, thereby heating the molten pig iron by heat of the combustion reaction.

8 Claims, No Drawings

METHOD FOR MANUFACTURING MOLTEN IRON

TECHNICAL FIELD

The present invention relates to a method for producing molten iron. The method of the present invention also relates to a method for improving a LD converter operation method in the production of molten iron.

BACKGROUND ART

In the current steel industry, blast furnace-converter processes are widely used and predominant. In a blast furnace process, iron ore, which is a main starting material, is reduced by blowing high-temperature heated air into it, using coke as a reductant, thereby obtaining carbon-saturated molten iron, which is called molten pig iron.

Other known processes for producing molten pig iron include DIOS, FINEX, and SMP (Scrap Melting Process). Since reduced iron obtained by reducing iron ore with natural gas or coal is generally obtained in a solid state, it is used as a secondary iron material in a converter process or an electric arc furnace process.

In general, molten pig iron includes sulfur, carbon, and phosphorus in amounts harmful to steels. Particularly, Cu contained in scrap iron cannot be removed in SMP, which causes various disadvantages.

Of these, regarding sulfur, desulfurization treatment is performed as a treatment prior to converter refining because a desulfurization reaction is likely to proceed under a reduced atmosphere, as the temperature is high. Thereafter, molten pig iron that has been subjected to desulfurization treatment is supplied into a converter; and supersonic pure oxygen gas is blown from above using a metal lance whose exterior has been water-cooled, or pure oxygen gas is blown from an oxygen gas inlet provided at the bottom of the converter, or a method including both steps is used to cause a decarburization reaction, thereby adjusting the amount of carbon and the temperature to desired levels. Regarding phosphorous, although dephosphorization treatment has recently been performed as a step prior to converter refining, the use of burned lime in converter refining allows for the relatively easy removal of phosphorous.

The essential role of converter refining is to adjust the amount of carbon to a desired level by a decarburization reaction and to control temperature to ensure smooth operation in the subsequent step. A decarburization reaction by pure oxygen gas is an exothermic reaction; the temperature of molten iron rises along with the development of the decarburization reaction, and the temperature may exceed a desired level. In such a case, scrap iron or the like is generally used; the melting heat of scrap iron is utilized to prevent the temperature from becoming excessively high. Examples of materials used for inhibiting such temperature rise, e.g., coolants, include iron ore, limestone, and the like, in addition to scrap iron.

In such a conventional converter process, one known problem is that a large amount of converter dust is generated. The generation of converter dust causes loss of sensible heat that is brought out of the converter by dust, and economic loss such as dust disposal cost, as well as about 3% iron yield loss during converter refining. Therefore, dust generation reduction has been an object in the converter process.

It is known that converter dust is generated by the following three phenomena.

1) When pure oxygen gas is blown into molten pig iron in a converter, the temperature of the pure oxygen gas blown into the molten pig iron suddenly rises from about 300K to about 1770K. Therefore, the pure oxygen gas expands to roughly about 6 times its initial volume. The pure oxygen gas is reacted with carbon in the molten pig iron while floating in the molten pig iron, and converts to CO gas having a double volume. The CO gas bubbles float in the molten pig iron while increasing their temperatures by the reaction heat of carbon in the molten iron and pure oxygen gas at an atmosphere temperature of about 1770K, and then burst when escaping from the surface of the molten iron. Since the CO bubbles rise up to the surface and burst while expanding, large amounts of molten iron splashes are scattered in an atmosphere. The splashes are removed from the converter together with exhaust gas, and collected as converter dust in a dust collector. Although some of the molten iron splashes are oxidized with oxygen in an atmosphere, those having a large particle size are oxidized only at the surface, and the inside is present as iron and collected as so-called coarse particle dust. The converter dust is called bubble-burst dust, and the generation of bubble-burst dust increases in proportion to the amount of decarburization by pure oxygen gas.

2) When in contact with molten iron, pure oxygen gas is reacted with carbon or iron to form a relatively high-temperature region called a firing point. The temperature of the firing point is said to be a high temperature exceeding the boiling point of iron, i.e., 2750° C. In this firing point region, iron vapor is generated, and removed from the converter together with exhaust gas. The iron vapor is oxidized by oxygen in an atmosphere to become a finely divided iron oxide called fume dust. This fume dust is collected by a dust collector, and used again as a starting material.

3) When a pure oxygen gas jet collides with molten pig iron, a concave is formed on the surface of the molten pig iron depending on collision conditions, and some molten iron particles are blown off by a gas jet that flows along the concave. This phenomenon is called spitting, and dust generated by this phenomenon is called spitting dust. Most spitting dust is coarse particles, and collected as coarse particle dust.

Various methods are suggested to inhibit the generation of converter dust. For example, Patent Literature 1 discloses optimizing the angle, diameter, and position between axial center sides of two or more cyclic gas nozzles concentrically disposed at a top-submerged lance to smooth a gas jet ejected from a lance in the circumferential direction and the radial direction, thereby reducing dust resulting from spitting.

Patent Literature 2 to 6 disclose methods for preventing spitting dust or fume dust. In these methods, since the amount of decarburization by pure oxygen gas is not reduced, reduction in bubble-burst dust cannot be expected. To reduce spitting dust, soft blowing of an oxygen jet is effective. As described in the aforementioned patent literature, various methods are known in which the shape of a jet is changed, the distance between a lance and the surface of molten pig iron is increased to keep an appropriate colliding force of an oxygen jet, two or more oxygen jet outlets are provided and a suitable jet angle is determined, slag with a low viscosity is formed at an early stage and spitting dust is obtained by the slag, etc. Regarding a method for preventing fume dust, in principle, fume dust can be prevented by reducing the firing point; however, the use of material only for reducing the firing point results in energy loss. Accordingly, this method is generally not employed.

Thus, the prevention of converter dust involves the essential part of converter refining; this is a problem that, thus far, remains unsolved.

CITATION LIST

Patent Literature

PTL 1: Japanese Unexamined Patent Publication No. H9-256022
PTL 2: Japanese Unexamined Patent Publication No. H6-256832
PTL 3: Japanese Unexamined Patent Publication No. 2005-15891
PTL 4: Japanese Unexamined Patent Publication No. 2005-290515
PTL 5: Japanese Unexamined Patent Publication No. S58-193309
PTL 6: Japanese Unexamined Patent Publication No. 2006-342370

SUMMARY OF INVENTION

Technical Problem

The primary object of the present invention is to minimize the generation of converter dust. By minimizing dust generation in the converter process, the present invention enjoys energy-saving effects, improves iron yield, and enjoys economical effects, e.g., reduction in dust disposal cost.

The second object of the present invention is to increase the thermal degree of freedom in the converter process, thereby increasing the options of usable iron source depending on the market conditions. The description "increasing options of usable iron source depending on the market conditions" indicates the following.

Sensible heat of molten pig iron and reaction heat of combustion material in the molten pig iron are only heat sources in converter refining. As a special case, a heat source is added by newly adding a carbon source to molten pig iron during converter refining. Thus, in converter refining, since the heat source possessed by the main starting material is limited, there has been only freedom of choice regarding the secondary iron source within the limited heat source.

As a secondary iron source, scrap iron, iron ore, reduced iron, or the like, can be used; however, the prices thereof change considerably according to market conditions. If the price of scrap iron drastically falls, the use of more scrap iron than molten pig iron obtained by a blast furnace method is economically advantageous; however, the amount of scrap iron used is limited by heat source limitations. Conversely, if the price of scrap iron is suddenly raised, the use of a large amount of iron ore, etc., is advantageous; however, since iron ore consumes more than three times more heat than scrap iron, the amount of iron ore used is increasingly limited. The second object of the present invention is to solve this problem, and increase the freedom of choice of secondary iron source.

Solution to Problem

The present inventors conducted extensive research to solve the above problems, and found that the problems can be solved by a method for producing molten iron comprising the steps of 1) supplying carbon-containing molten pig iron to a converter, 2) continuously supplying iron oxide into the converter, and 3) blowing a mixed gas comprising a fuel gas and a combustion-supporting gas at a speed equal to or faster than the speed of sound to the molten pig iron to cause a combustion reaction, thereby utilizing the combustion reaction heat to heat the molten pig iron so that heat is stored therein. Based on this finding, the inventors conducted further research, and accomplished the present invention.

Specifically, the present invention provides inventions according to the following embodiments.

1. A method for producing molten iron comprising the steps of:

1) supplying carbon-containing molten pig iron to a converter, 2) continuously supplying iron oxide into the converter, and 3) blowing a mixed gas comprising a fuel gas and a combustion-supporting gas at a speed equal to or faster than the speed of sound to the molten pig iron to cause a combustion reaction, thereby heating the molten pig iron by heat of the combustion reaction.

2. The method according to Item 1, wherein the amount of iron oxide added is equal to or greater than the amount of iron oxide comprising the amount of carbon contained in the molten pig iron supplied in step 1) and the amount of oxygen required for reducing the amount of other chemical components bindable to oxygen to a desirable level.

3. The method according to Item 1 or 2 comprising: mixing a fuel gas and a combustion-supporting gas in a metal tube, the outside of the metal tube being water-cooled, and performing ejection at a speed equal to or faster than the speed of sound from a de Laval nozzle provided at an end of the water-cooled metal tube so that blowing is performed from above molten pig iron and iron oxide.

4. The method according to any one of Items 1 to 3, wherein a mixed gas comprising a fuel gas and a combustion-supporting gas is blown into molten pig iron from the bottom of a converter to cause a combustion reaction in the molten pig iron, thereby heating the molten pig iron.

Effect of the Invention

According to the method of the present invention, the generation of converter dust can be minimized to enjoy energy saving effects, improve iron yield, and enjoy economical effects such as reduction in dust disposal cost. Further, by using the combustion reaction heat of a fuel gas and a combustion-supporting gas, the method of the present invention can increase the thermal degree of freedom in the converter process; consequently, the options of iron source used depending on the market conditions can be increased. Specifically, the method of the present invention provides a method for improving a converter operation method in the production of steels.

DESCRIPTION OF EMBODIMENTS

The method for producing molten iron of the present invention comprises the steps of 1) supplying carbon-containing molten pig iron to a converter, 2) continuously supplying iron oxide into the converter, and 3) blowing a mixed gas comprising a fuel gas and a combustion-supporting gas at a speed equal to or faster than the speed of sound to the molten pig iron to cause a combustion reaction, thereby heating the molten pig iron by heat of the combustion reaction.

The steps of the production method of the present invention are explained in detail below.

1. Step 1

In Step 1, carbon-containing molten pig iron is supplied to a converter.

The amount of carbon in the molten pig iron is not particularly limited, and may be 1 to 5 wt %, and preferably 3 to 5 wt % in the molten iron. The carbon-containing molten pig iron used in Step 1 may be tapped from a blast furnace. Molten pig iron that has been previously subjected to a desulfurization reaction, dephosphorization reaction, or the like, can also be used.

In the present invention, scrap iron may be supplied to a converter together with the carbon-containing molten pig iron. The scrap iron is not particularly limited, and any scrap iron that is generally used in this field can be used. The shape and size of the scrap iron are not particularly limited, and can be suitably determined.

The amounts of the molten pig iron and the scrap iron supplied are not particularly limited, and can be suitably determined depending on the capacity, etc., of the converter used. For example, the scrap iron is used in an amount of 30 parts by weight or less relative to 100 parts by weight of the carbon-containing molten pig iron. When the amount of the scrap iron is outside the above range, the required heat supply is increased, thus resulting in a prolonged refining time, which is likely to disturb the time balance of the entire process. Therefore, the amount of scrap iron may be selected based on the comprehensive consideration of economical efficiency of the entire steel manufacturing process, market conditions of scrap iron, or the like.

In the converter, an inlet of a mixed gas of a fuel gas and a combustion-supporting gas to be used in Step 3 can be provided at the top, the bottom, and/or a side of the container. When the mixed gas is supplied from the bottom and/or a side, it does not have to have a speed equal to or faster than the speed of sound.

2. Step 2

In Step 2, operation is carried out for the purpose of obtaining molten iron that contains a desired amount of carbon through decarburization reaction, which is the primary purpose of converter refining, obtaining molten iron having a desired temperature for the subsequent step, and obtaining molten iron that contains phosphorous in an amount required for the material of desired steels.

In Step 2, iron oxide that is mainly used as an oxygen source in a decarburization reaction is continuously supplied to the converter. "Continuously" as used herein indicates that iron oxide is continuously added to the converter until the amount of carbon in the molten pig iron attains a desired level. If the addition of iron oxide stops under a condition such that the amount of carbon in the molten iron is large, $CO_2$ and/or $H_2O$ generated by the combustion reaction is reacted with carbon in the molten iron to generate CO gas and/or $H_2$ gas, respectively, which reduces the amount of heat generated in the combustion reaction. Namely, an endothermic reaction occurs to lower the thermal efficiency of the fuel gas.

In general, the converter refining time is about 10 to 30 minutes, and the supply rate of the iron oxide is not particularly limited. The supply rate of the iron oxide is preferably about 0.1 to 10 t/min, and more preferably about 2 to 7 t/min.

The supply time is suitably determined based on the supply amount and supply rate of the iron oxide determined by the amount of the molten pig iron supplied in Step 1. For example, it is preferable that the iron oxide be continuously supplied into the converter for 1 to 30 minutes, preferably 10 to 30 minutes, and more preferably 10 to 20 minutes.

Examples of the iron oxide include iron ore, fine ore pellets, sintered ore, iron dust pellets, iron dust briquettes, and the like.

The present invention has a feature in that iron oxide such as iron ore is mainly used as an oxygen-supplying source required for a decarburization reaction. In the conventional converter process, a method in which a decarburization reaction is performed by blowing pure oxygen gas into molten iron has been widely used. Therefore, the present invention, in which a decarburization reaction is performed using oxygen in iron oxide as a main oxygen-supplying source, is a completely novel technique.

The decarburization reaction caused by oxygen in iron oxide is a reduction reaction of iron oxide. Since the reduction reaction is an endothermic reaction, it is necessary to supply a large amount of heat from outside for the reaction. However, supplying such a heat source was conventionally difficult; therefore, a decarburization reaction in which oxygen contained in iron oxide is used as a main oxygen-supplying source was not performed. In the present invention, the mixed gas of a fuel gas and a combustion-supporting gas described below is blown into the molten iron to cause a combustion reaction, thereby heating the molten iron by the combustion reaction heat so that heat is stored in the molten iron. In this manner, the main decarburization reaction can be converted to the reduction reaction (endothermic reaction) of iron oxide.

In the present invention, by performing a decarburization reaction caused by oxygen in the iron oxide, the generation of converter dust can be extremely minimized. This mechanism will be explained below using, for example, iron ore as an oxygen source.

Since iron ore does not mix with molten iron, and has a smaller specific gravity than the molten iron, the iron ore added to the converter is caught in the molten iron together with a mixed gas jet of a fuel gas and a combustion-supporting gas, then rises up to the surface, and floats on the surface of the molten iron. When the iron ore is in contact with carbon dissolved in the molten iron, the carbon is immediately combined with oxygen in the iron ore to generate CO gas, because the carbon has a remarkably high degree of activity. The iron content in the iron ore is reduced to become iron, and this reduction reaction occurs at the surface of the iron ore. Further, since this reaction is an endothermic reaction, the temperature of CO gas bubbles is likely to fall as the reaction proceeds. Therefore, this is completely different from the behavior of CO gas bubbles in a decarburization reaction by pure oxygen gas, in which bubbles grow with sudden volume expansion.

Even though temporally caught in the molten iron, since iron ore having a smaller specific gravity than the molten iron always rises up near the surface of the molten iron, CO gas bubbles generated by a reduction reaction occurring at the surface of the iron ore are always removed from near the surface of the molten iron to an atmosphere, and a bubble-burst phenomenon caused by CO gas bubbles generated during a decarburization reaction by pure oxygen gas does not occur.

Since the contact surface of the iron ore and the molten pig iron is cooled by the iron ore having an ordinal temperature, and the decarburization reaction is an endothermic reaction, the high temperature range (range exceeding the boiling point of iron, i.e., 2750° C.) called a firing point is not formed. Therefore, the generation of fume dust in which iron is evaporated can also be prevented.

Specifically, in the production method of the present invention, since generation of bubble-burst and fume dust can be prevented, generation of converter dust can be extremely minimized. Additionally, by using a conventionally known spitting dust-prevention method, generation of converter dust can almost be completely prevented.

The amount of the iron oxide added is preferably equal to or greater than the amount of iron oxide that contains the amount of carbon that is dissolved in the molten pig iron supplied in Step 1 and the amount of oxygen required for reducing the amount of other chemical components (e.g., phosphorous, silicon, etc.) that are bindable to oxygen to a desired level.

The molten pig iron supplied to the converter in Step 1 contains carbon, and chemical components that are bindable to oxygen, e.g., phosphorous and silicon. For example, carbon is combined with oxygen to form CO or $CO_2$ (decarburization reaction), phosphorus is combined with oxygen to form phosphoric ion ($PO_4^{3-}$) (dephosphorization reaction), and silicon is combined with oxygen to form silicon dioxide ($SiO_2$), followed by burning (desiliconization reaction). Therefore, the amount of each component in the molten iron is measured, and the amount of oxygen required for reducing the amount of each component to a desired level is determined. Based on the amount of oxygen, the amount of iron oxide is determined. In the present invention, iron oxide is preferably added in an amount exceeding the determined amount.

The desired amount used herein can be suitably determined according to the purpose of use of the resulting molten iron. For example, the amount of carbon in the molten iron is preferably about 0.40 wt % or less, and the amount of phosphorous is preferably about 0.030 wt % or less.

It is preferable that iron oxide be added in consideration of the amount of iron oxide contained in the slag generated by the production method of the present invention, loss during the addition of the iron oxide, and the like. Specifically, the maximum amount of iron oxide to be added in the present invention is the sum of the iron oxide that contains oxygen in an amount required for reducing the amount of each component to a desired level, the iron oxide contained in slag, and the iron oxide that is to be lost during addition.

Specifically, when iron ore is used, it is preferable to use iron ore in an amount of 24 to 30 wt % based on the total amount of molten pig iron used. In the conventional converter operation, the limit of iron ore is about 10% relative to the amount of molten pig iron. In the present invention, iron ore can be used in an amount about 2 to 3 times the amount of iron ore used in the conventional operation.

The limit of the amount of iron ore used in the present invention can be determined mainly based on the amount of oxygen excluding the amounts of carbon, silicon, manganese, phosphorus, and the like, contained in the molten pig iron. Of these, since the amounts of phosphorus and manganese are small, they have little effect on the decision of the amount of iron ore. Specifically, to determine the amount of iron ore, the amounts of carbon and silicon in the molten pig iron must be considered. On the other hand, in the conventional converter operation, the limit of the amount of iron ore is determined based on a heat source. When common molten pig iron is used, the maximum limit of the scrap iron is approximately 30 wt %, and the maximum limit of iron ore is approximately 10 wt %.

3. Step 3

In Step 3 of the present invention, a mixed gas comprising a fuel gas and a combustion-supporting gas is blown at a speed equal to or faster than the speed of sound to the molten pig iron to cause a combustion reaction, and the molten pig iron is heated using the heat of the combustion reaction.

As explained above, by blowing the mixed gas of a fuel gas and a combustion-supporting gas into the molten pig iron, the heat required for promoting a decarburization reaction in which the oxygen in the iron oxide is used as the main oxygen-supplying source can be supplied.

The blowing speed of the mixed gas is equal to or faster than the speed of sound, and preferably about Mach 1 to 3. In the present invention, since the blowing speed of the mixed gas is equal to or faster than the speed of sound, high mechanical energy can be attained. Accordingly, the mixed gas can deeply enter into the molten iron to transfer the combustion reaction heat to the molten iron, which makes it possible to heat the molten iron to a desired temperature level with high heat efficiency.

Examples of the fuel gas include a gas that burns with a combustion-supporting gas to form $CO_2$ and/or $H_2O$, such as LNG (liquefied natural gas), LPG (liquefied petroleum gas), butane gas, coke furnace gas, spray heavy oil, spray gas oil, and the like.

Examples of the combustion-supporting gas include pure oxygen, air, etc.

The fuel gas and the combustion-supporting gas may be mixed, for example, at a ratio such that perfect combustion is achieved. Since the perfect combustion mixing ratio varies depending on the kinds of gases used, the ratio can be suitably determined according to the kinds of fuel gas and combustion-supporting gas used. For example, when the fuel gas is LNG and the combustion-supporting gas is pure oxygen gas, the perfect combustion ratio (volume ratio) is such that fuel gas:combustion-supporting gas=1:2.30; and when the fuel gas is LPG and the combustion-supporting gas is pure oxygen gas, the perfect combustion ratio (volume ratio) is such that fuel gas:combustion-supporting gas is 1:5.12.

In the present invention, reaction in the converter can be controlled according to the mixing ratio of the fuel gas and the combustion-supporting gas in the mixed gas. Specifically, if the ratio of the fuel gas in the mixed gas is set higher than the perfect combustion ratio, since unreacted fuel gas is contained in gas generated by a combustion reaction, a reducing atmosphere is formed. Conversely, if the ratio of the combustion-supporting gas is set high, an oxidizing atmosphere is formed. By using such an atmosphere-controlling mechanism, the decarburization reaction and dephosphorization reaction can be controlled.

Under such circumstances, the ratio of the fuel gas and the combustion-supporting gas is determined based on the time allowed for refining. Specifically, the decarburization reaction in the molten iron proceeds as the ratio of the combustion-supporting gas in the blown gas increases (i.e., oxidizing atmosphere); however, along with the reaction, the ratio of the decarburization reaction by pure oxygen gas is increased, which causes a bubble-burst phenomenon. Alternatively, because the firing point is easily formed, the generation of dust is increased. Accordingly, within the time tolerance, it is preferable to prioritize the decarburization reaction caused by iron oxide.

Because of the reasons described above, the mixing ratio of the fuel gas and the combustion-supporting gas cannot be determined; however, for example, it is about 1:1 to 10 (fuel gas:combustion-supporting gas at a volume ratio).

The heating temperature of the molten iron is suitably determined considering the relation with the subsequent step. In general, the heating temperature of the molten iron is about 1600 to 1700° C., and about 1620 to 1680° C.

In the present invention, the molten iron can be heated by the combustion reaction heat. Simultaneously, the molten iron can be vigorously stirred using exhaust gas ($CO_2$ gas and/or $H_2O$ gas) that is generated by hot combustion reaction heat.

To enhance stirring of the molten iron, gas such as oxygen gas, nitrogen gas, air, carbon dioxide, fuel gas, or the like can be blown from a side at a position that is lower than the surface of the molten iron, or from the bottom of the converter.

In the present invention, it is preferable that a fuel gas and a combustion-supporting gas be mixed in a metal tube whose exterior has been water-cooled, that the mixed gas be ejected at a speed equal to or faster than the speed of sound using a de Laval nozzle that is disposed at the end of the water-cooled metal tube, and that the mixed gas be blown from above the molten iron and the oxide iron so that a combustion reaction occurs near the surface of the molten iron or inside the molten iron. Alternatively, the mixed gas of the fuel gas and the combustion-supporting gas can be blown from the bottom of the converter to the molten iron to cause a combustion reaction in the molten iron. This technique can be used together with the blowing from above.

At least one outlet of the mixed gas of the metal tube is preferably located near the surface of the molten iron, and within such a range that damage of the lance tip caused by molten iron splashes generated by a gas jet is not severe. Setting the position of the outlet within such a range is preferable because the mixed gas can be blown into the molten iron as deeply as possible. Although a specific value cannot be easily determined because it varies depending on the shape, size, etc., of the converter, the outlet may be located at about 0.5 to 2.5 m, preferably about 1 to 2 m from the surface of the molten iron.

To attain a speed equal to or faster than the speed of sound at the end of the nozzle, it is preferable that the metal tube include a de Laval nozzle at the tip, and that the mixed gas be formed in the de Laval nozzle. Such a method for producing a gas jet having a speed equal to or faster than the speed of sound is widely known for the de Laval nozzle technique, as disclosed, for example, in Japanese Unexamined Patent Publication No. H6-73431 and Japanese Unexamined Patent Publication No. H6-73433.

Since the temperature of the molten iron is set about 100° C. higher than the melting point that corresponds to the amount of carbon, the mixed gas of the fuel gas and the combustion-supporting gas that has entered into the molten iron is in a state such that the mixed gas is sealed in a reaction chamber at a high temperature of approximately 1253° C. or, more. This promptly causes a combustion reaction, and results in perfect combustion, even if an unreacted portion remains. The thus-formed exhaust gas bubbles (i.e., exhaust gas obtained by the combustion reaction) rise up to the surface through the molten iron while exchanging heat. In the course of this process, some of the exhaust gas bubbles obtained by the combustion reaction are combined with carbon in the molten iron to cause an endothermic reaction, i.e., $CO_2+C=>2CO$ and/or $H_2O+C=>H_2+CO$; and consequently, the comprehensive thermal efficiency becomes about 80%.

In order to efficiently collect iron in the iron oxide that is reduced by carbon in the molten iron, it is preferable that the molten iron and oxide iron be strongly stirred. From this viewpoint, it is preferable that the float position of the exhaust gas bubbles generated by the mixed gas that has been blown into the molten iron be adjusted to be located under the oxide iron that is floating over the surface of the molten iron. The float position may be adjusted according to the position in which the fuel gas and the combustion-supporting gas are supplied (e.g., supplied from the bottom of the converter), the blowing pressure and the blowing angle from above, etc.

Outlets (preferably 2 to 6, more preferably 6) for the mixed gas having a speed equal to or faster than the speed of sound can be provided not only in the vertical direction, but also with a dip angle of not more than 45° with respect to the vertical axis.

The amounts of the fuel gas and the combustion-supporting gas supplied can be suitably determined according to the heating temperature, the amount of the molten iron supplied, etc., and there are no particular limitations.

Since the molten pig iron generally contains harmful phosphorous, it is preferable to perform a dephosphorization reaction to remove phosphorous in the present invention. As a dephosphorization method, a method in which burned lime is added is known. In the conventional converter operation, as carbon in molten iron is reduced, iron is oxidized by pure oxygen gas to form iron oxide. When burned lime, which is added as a secondary material, and the iron oxide are both present, phosphorous is oxidized to become phosphoric acid, and the phosphoric acid is reacted with burned lime to advance the dephosphorization reaction. However, in the present invention, iron ore that is required for the oxidation of the phosphorus is added beforehand. The amount of burned lime is not particularly limited, and can be suitably determined according to the amount of phosphorous in the molten iron.

In the production method of the present invention, about half of the total amount of burned lime is first added to the converter, and the mixed gas of the fuel gas and the combustion-supporting gas is blown to move the burned lime to the wall of the converter. Thereafter, iron oxide is supplied to the center region of the converter to cause a decarburization reaction.

The remaining burned lime is preferably added when the amount of carbon in the molten iron is reduced to the greatest extent possible. It is preferable that the burned lime be added after the amount of carbon in the molten iron becomes about 0.4%; however, when there is insufficient time to complete the melting of burned lime and dephosphorization reaction due to refining time restrictions, the burned lime may be added before the amount of the carbon in the molten iron becomes about 0.4%.

In the present invention, when the amount of the carbon in the molten iron is reduced to about 0.4%, the activity of the carbon in the molten iron is lowered, which slows the reaction with oxygen in the iron oxide. Therefore, to raise, in particular, the decarburization reaction speed, the amount of the fuel gas in the mixed gas to be blown into the molten iron is reduced, or only pure oxygen gas is used (i.e., no fuel gas is used). By these methods, a decarburization reaction can be promoted by a gas having a strong oxidation power. In this case, the amount of iron ore to be added must be reduced by an amount that corresponds to a reduction in the carbon amount from 0.4% to a desired level. If decarburization by pure oxygen gas is performed, bubble-burst dust is increased in proportion to the amount of decarburization.

In the present invention, by using the combustion reaction heat of the fuel gas and the combustion-supporting gas, the thermal degree of freedom in a converter process can be increased. An increase in the thermal degree of freedom makes it possible to choose iron ore or scrap iron according to cost advantages in the market. Since about 3 times or more the amount of heat is needed when iron ore is used compared to when scrap iron is used, the amount of iron ore used is strictly limited in view of the balance between a desired steel material production amount and an available amount of molten pig iron. Increasing the thermal degree of freedom in a converter process remarkably alleviates this limitation.

Although this is an unusual case, when a blast furnace does not work well, the supply of molten pig iron is stopped or extremely lowered. When the blast furnace does not work well, since the supply of molten pig iron from the uppermost step is lowered, the operation efficiency of the entire steel mill falls, which causes excessive losses. Conventionally, when a blast furnace falls into bad condition, the amount of scrap iron is increased to minimize damage, and the heat source loss due to the increase in the scrap iron is covered by adding a carbon source such as anthracite and soil graphite, and combusting the carbon source with pure oxygen gas. However, this method has limitations, and when the blast furnace falls into bad condition, a significant production reduction is usually inevitable. An increase in the thermal degree of freedom in a converter process can significantly reduce damage, even when such an unexpected incident takes place.

EXAMPLES

The present invention will be described in more detail below by way of Examples; however, the scope of the invention is not limited by these Examples.

Comparative Example

Conventional Converter Operation Method

A converter facility in which a converter had a maximum charge of 130 t was used. 100 t of molten pig iron having a temperature after desulfurization treatment of 1450° C. and containing carbon in an amount of about 4.5 wt %, phosphorous in an amount of 0.125 wt %, and silicon in an amount of 0.30%, and 15 t of scrap iron were put in the converter. Thereafter, pure oxygen gas was blown from above the converter through a de Laval nozzle provided at the tip of a metal lance, the outside of which was water-cooled. Carbon dioxide was then blown from the bottom of the converter to enhance stirring of the molten iron. Immediately after the pure oxygen gas was reacted with the molten pig iron to cause ignition, 5 t of burned lime was supplied from above to the inside of the converter.

The pure oxygen gas was blown at about Mach 2.0 and at a flow rate of about 20,000 $Nm^3$/hour. 5,340 $Nm^3$ of pure oxygen gas was flowed over 16 minutes, and the temperature of the molten iron was measured in the middle of the operation. 700 kg of iron ore (iron content: about 63 wt %) was then added, and refining was completed.

The temperature of the molten iron at the time of completion of refining was 1650° C. The carbon content was 0.08 wt %, and the phosphorus content was 0.015 wt %. The production of the molten iron was 105.2 t, and the iron yield calculated therefrom was as follows:

$$\text{Iron yield (\%)} = \frac{\text{the amount of molten iron}}{\text{the amount of iron in molten pig iron} + \text{the amount of iron in scrap iron} + \text{the amount of iron in iron ore}} \times 100 = \frac{105.2}{95 + 15 + 0.44} \times 100 = 95.26\%$$

About 1 t of iron was splashed from the converter during converter refining, the amount of converter dust generated was 3.4 t, and the amount of iron that was discharged with slag was 0.8 t.

Example 1

The converter facility in which the converter had a maximum charge of t, which was the same converter facility used in the Comparative Example, was used. 100 t of molten pig iron having a temperature after desulfurization treatment of 1450° C. and containing carbon in an amount of about 4.5 wt %, phosphorous in an amount of 0.125 wt %, and silicon in an amount of 0.30 wt % was put in the converter. Thereafter, a mixed gas in which the mixing ratio of LNG and pure oxygen gas was 1:2.3 was blown at a speed of about Mach 2.0 and at a flow rate of about 51,000 $Nm^3$/h from above (above the molten iron) to inside of the converter through the de Laval nozzle provided at the tip of the metal lance, the outside of which was water-cooled. Carbon dioxide was then blown from the bottom of the converter to enhance stirring of the molten iron. Immediately thereafter, 3.5 t of burned lime was supplied from above to the inside of the converter. Immediately after the supply of the burned lime was completed, the supply of iron ore (iron content: about 63 wt %) that had been dried in another equipment was started. The total amount of iron ore used was 25 t, and the iron ore was continuously supplied for about 13 minutes at a rate of about 2 t/min. About 5 minutes before the completion of refining, 2 t of burned lime was supplied to the converter.

The amount of the mixed gas used during refining was about 12,750 $Nm^3$, and the mixed gas was supplied for about 15 minutes. In this case, LNG, which was a fuel gas, had a molten iron unit of about 35.7 $Nm^3$/t. The heat efficiency to molten iron calculated from the amount of heat generated by the combustion of LNG was about 75%.

The temperature of the molten iron at the time of completion of refining was 1650° C., the carbon content was 0.08 wt %, and the phosphorus content was 0.017 wt %. The production of molten iron was 108.8 t, and the iron yield calculated therefrom was as follows:

$$\text{Iron yield (\%)} = \frac{\text{the amount of molten iron}}{\text{the amount of iron in molten pig iron} + \text{the amount of iron in iron ore}} \times 100 = \frac{108.8}{95 + 15.75} \times 100 = 98.24\%$$

About 1 t of iron was splashed from the converter during converter refining, the amount of converter dust generated was 0.2 t, and the amount of iron that was discharged with slag was 0.8 t.

When compared to the operation results of the Comparative Example that uses the conventional converter refining method, the production of molten iron obtained using the same amount of molten pig iron, which was the main starting material, was increased by 3.6 t, and the amount of converter dust generated was reduced by 3.2 t. In addition, a comparison between the Comparative Example and Example 1 confirmed that even when scrap iron and iron ore were compared, and one that had a cost advantage was selected and used depending on the market price, the amount of the resulting molten iron was almost the same. This indicates that the options for a main starting material were increased.

Example 2

Iron Ore Containing Moisture in an Amount of 20% was Used

The converter facility in which the converter had a maximum charge of 130 t, which was the same converter facility used in the Comparative Example, was used. 100 t of molten pig iron having a temperature after desulfurization treatment of 1450° C. and containing carbon in an amount of about 4.5 wt %, phosphorous in an amount of 0.125 wt %, and silicon in an amount of 0.3 wt % was put in the converter. Thereafter, the metal lance, the outside of which was water-cooled was put from above to inside of the converter, and a mixed gas in which the mixing ratio of LNG and pure oxygen gas was 1:2.3 was blown at a speed of about Mach 2.0 and a flow rate of about 51,000 $Nm^3/h$ from above the molten iron. Carbon dioxide was blown from the bottom of the converter to enhance the stirring of the molten iron. Immediately thereafter, 3.5 t of burned lime was supplied from above to the inside of the converter. Immediately after the completion of the supply of the burned lime, the supply of iron ore containing moisture in an amount of about 20% (iron content during drying: about 63 wt %) was started. The total amount of iron ore containing moisture was about 30 t. The iron ore was continuously supplied at a rate of about 2 t/min for about 15 minutes. Five minutes before the completion of refining, 2 t of burned lime was supplied to the converter.

The amount of the mixed gas used during refining was about 17,000 $Nm^3$, and the mixed gas was supplied for about 20 minutes. In this case, LNG, which was a fuel gas, had a molten iron unit of about 47.1 $Nm^3/t$ molten iron. The heat efficiency to molten iron calculated from the amount of heat generated by the combustion of LNG was about 57%.

The temperature of the molten iron at the time of completion of refining was 1650° C., the carbon content was 0.08 wt %, and the phosphorus content was 0.017 wt %. The production of molten iron was 108.6 t, and the iron yield calculated therefrom was as follows:

$$\text{Iron yield (\%)} = \frac{\text{the amount of molten iron}}{\text{the amount of iron in molten pig iron} + \text{the amount of iron in iron ore}} \times 100 = \frac{108.6}{95 + 15.75} \times 100 = 98.06\%$$

About 1 t of iron was splashed from the converter during converter refining, the amount of converter dust generated was 0.4 t, and the amount of iron that was discharged with slag was 0.8 t.

It is revealed that the moisture contained in the iron ore used deteriorated the heat efficiency of fuel to molten iron by about 18%. Moreover, it is presumed that the amount of converter dust was increased because of bubbles generated by vaporization of moisture. It is preferable that the iron ore be dried using sensible heat of a certain exhaust gas, and then used.

Example 3

The converter facility in which the converter had a maximum charge of 130 t, which was the same converter facility used in the Comparative Example, was used. 100 t of molten pig iron having a temperature after desulfurization treatment of 1450° C. and containing carbon in an amount of about 4.5 wt %, phosphorous in an amount of 0.125 wt %, and silicon in an amount of 0.30 wt % was put in the converter. Thereafter, a mixed gas in which the mixing ratio of LNG and pure oxygen gas was 1:2.3 was blown at a speed of about Mach 2.0 and a flow rate of about 51,000 $Nm^3/h$ from above (above the molten iron) to inside of the converter through the de Laval nozzle provided at the tip of the metal lance, the outside of which was water-cooled, and carbon dioxide was blown from the bottom of the converter to enhance the stirring of the molten iron. Immediately thereafter, 3.5 t of burned lime was supplied from above to the inside of the converter. Immediately after the completion of supply of the burned lime, the supply of iron ore (iron content: about 63 wt %) that had been dried in another equipment was started. About ten minutes after refining had started, pulverized coal was added at a rate of about 0.6 t/min for about 8 minutes from a pulverized coal inlet provided at the bottom of the converter, using a nitrogen gas as a carrier gas. About 4.5 t of pulverized coal was supplied, and the operation was completed. During this operation, iron ore was continuously added.

About 38 t (total amount) of iron ore was added over about 19 minutes (supply rate: about 2 ton/min). After the completion of the supply of the iron ore, about 3 t of remaining burned lime was added, and refining was completed in about 24 minutes.

The amount of the mixed gas used during refining was about 20,300 $Nm^3$, and the mixed gas was supplied for about 24 minutes. In this case, LNG, which was a fuel gas, had a molten iron unit of about 53.3 $Nm^3/t$. The heat efficiency to molten iron calculated from the amount of heat generated by the combustion of LNG was about 75%.

The temperature of the molten iron at the time of completion of refining was 1650° C., the carbon content was 0.08 wt %, and the phosphorus content was 0.017 wt %. The production of molten iron was 116.94 t, and the iron yield calculated therefrom was as follows:

$$\text{Iron yield (\%)} = \frac{\text{the amount of molten iron}}{\text{the amount of iron in molten pig iron} + \text{the amount of iron in iron ore}} \times 100 = \frac{116.94}{95 + 23.94} \times 100 = 98.32\%$$

About 1 t of iron was splashed from the converter during converter refining, the amount of converter dust generated was 0.2 t, and the amount of iron that was discharged with slag was 0.8 t.

When compared to the operation results of the Comparative Example using the conventional converter refining method, the production of the molten iron obtained using the same amount of molten pig iron, which was the main starting material, was increased by 11.74 t, and the amount of converter dust generated was reduced by 3.2 t. This indicates that the present invention is an effective means for increasing the production of steel materials when the amount of molten pig iron is limited. In Example 3, the amount of the iron ore used was limited because of the limit of the facility; however, for example, it is possible to reduce the amount of the molten pig iron and increase the amount of the iron ore. In Example 3, coal that is necessary for the reduction of the iron ore was supplied as pulverized coal from the bottom of the converter; however, it is also possible to use briquettes in which powder iron ore and pulverized coal are previously mixed and solidified. In this case, it is presumed that the iron yield may be reduced by a certain degree because the powder rate is high.

The results of the Comparative Example, and Examples 1 and 2 are summarized in Table 1 below.

TABLE 1

| | Comparative Example | Example 1 | Example 2 | Example 3 |
|---|---|---|---|---|
| Molten pig iron (t) | 100 | 100 | 100 | 100 |
| Temperature of molten pig iron: 1450° C. | | | | |
| Amount of carbon: about 4.5% | | | | |
| Amount of phosphorous: 0.125% | | | | |
| Scrap iron (t) | 15 | — | | |
| Burned lime (t) | 5 | 3.5 | 3.5 | 3.5 |
| | | 2 (about 5 minutes before the completion of refining) | 2 (about 5 minutes before the completion of refining) | 3 (about 5 minutes before the completion of refining) |
| Gas | Pure oxygen gas | LNG and pure oxygen gas (mixing ratio) 1:2.3 | LNG and pure oxygen gas (mixing ratio) 1:2.3 | LNG and pure oxygen gas (mixing ratio) 1:2.3 |
| Mach | About 2.0 | About 2.0 | About 2.0 | About 2.0 |
| Flow rate ($Nm^3/h$) | About 20,000 | About 51,000 | About 51,000 | About 51,000 |
| Total flow amount ($Nm^3$) | 5,340 | 12,750 | 17,000 | 20,330 |
| Iron ore (t) | 0.7 | 25 | — | 38 |
| | | Supply rate: 2 t/min | | Supply rate: 2 t/min |
| | | Supply time: about 13 min | | Supply time: about 19 min |
| Iron ore containing about 20% moisture (t) | — | — | 30 | — |
| | | | Supply rate: 2 t/min | |
| | | | Supply time: about 13 | |
| Molten iron at the completion of refining | | | | |
| Temperature of molten iron (° C.) | 1650 | 1650 | 1650 | 1650 |
| Amount of carbon (%) | 0.08 | 0.08 | 0.08 | 0.08 |
| Amount of phosphorous (%) | 0.015 | 0.017 | 0.017 | 0.017 |
| Production of molten iron (t) | 105.2 | 108.8 | 108.6 | 116.94 |
| Iron yield (%) | 95.26 | 98.24 | 98.06 | 98.32 |
| Generation of converter dust (t) | 3.4 | 0.2 | 0.4 | 0.2 |

The invention claimed is:

1. A method for producing molten iron comprising the steps of:

1) supplying carbon-containing molten pig iron to a converter,
2) continuously supplying iron oxide into the converter to decarburize the pig iron, and
3) blowing a mixed gas comprising a fuel gas and a combustion-supporting gas, in an amount corresponding to the amount needed to combust the fuel gas, at a speed equal to or faster than the speed of sound to the molten pig iron to cause a combustion reaction, thereby heating the molten pig iron by heat of the combustion reaction.

2. The method according to claim 1, wherein the amount of iron oxide added is equal to or greater than the corresponding amount of carbon contained in the molten pig iron supplied in step 1) and the amount of oxygen required for reducing the amount of other chemical components bindable to oxygen to a desirable level.

3. The method according to claim 2 comprising: mixing a fuel gas and a combustion-supporting gas in a metal tube, the outside of the metal tube being water-cooled, and performing ejection at a speed equal to or faster than the speed of sound from a de Laval nozzle provided at an end of the water-cooled metal tube so that blowing is performed from above molten pig iron and iron oxide.

4. The method according to claim 2, wherein a mixed gas comprising a fuel gas and a combustion-supporting gas is blown into molten pig iron from the bottom of a converter to cause a combustion reaction in the molten pig iron, thereby heating the molten pig iron.

5. The method according to claim 3, wherein a mixed gas comprising a fuel gas and a combustion-supporting gas is blown into molten pig iron from the bottom of a converter to cause a combustion reaction in the molten pig iron, thereby heating the molten pig iron.

6. The method according to claim 1 comprising: mixing a fuel gas and a combustion-supporting gas in a metal tube, the outside of the metal tube being water-cooled, and performing ejection at a speed equal to or faster than the speed of sound from a de Laval nozzle provided at an end of the water-cooled metal tube so that blowing is performed from above molten pig iron and iron oxide.

7. The method according to claim 6, wherein a mixed gas comprising a fuel gas and a combustion-supporting gas is blown into molten pig iron from the bottom of a converter to cause a combustion reaction in the molten pig iron, thereby heating the molten pig iron.

8. The method according to claim 1, wherein a mixed gas comprising a fuel gas and a combustion-supporting gas is blown into molten pig iron from the bottom of a converter to cause a combustion reaction in the molten pig iron, thereby heating the molten pig iron.

* * * * *